United States Patent [19]

Rowley et al.

[11] Patent Number: 4,823,560

[45] Date of Patent: Apr. 25, 1989

[54] REFRIGERATION SYSTEM EMPLOYING REFRIGERANT OPERATED DUAL PURPOSE PUMP

[75] Inventors: C. Allen Rowley, Mesa; Hector M. Gutierrez, Phoenix, both of Ariz.

[73] Assignee: E Squared Inc., Mesa, Ariz.

[21] Appl. No.: 199,676

[22] Filed: May 27, 1988

[51] Int. Cl.[4] ..... F25B 1/00

[52] U.S. Cl. ..... 62/467; 60/593

[58] Field of Search ..... 62/467; 60/593

[56] References Cited

U.S. PATENT DOCUMENTS

| | | | |
|---|---|---|---|
| 1,091,957 | 3/1914 | Pollard | 62/498 |
| 1,264,399 | 4/1918 | Jones | 62/116 |
| 2,209,090 | 7/1940 | Pierotti et al. | 230/52 |
| 2,468,293 | 4/1949 | Du Pre | 62/136 |
| 2,637,981 | 5/1953 | Russell | 62/4 |
| 2,986,898 | 6/1961 | Wood, Jr. | 62/174 |
| 2,986,907 | 6/1961 | Hoop | 62/510 |
| 2,991,632 | 7/1961 | Rogers | 62/498 |
| 3,016,016 | 1/1962 | Horlacher | 103/48 |
| 3,710,586 | 1/1973 | Maudlin | 62/216 |
| 3,823,573 | 7/1974 | Cassady | 62/238 |
| 3,861,166 | 1/1975 | Goldsberry | 62/115 |
| 3,988,901 | 11/1976 | Shelton et al. | 62/116 |
| 4,617,801 | 10/1986 | Clark, Jr. | 62/467 |
| 4,693,090 | 9/1987 | Blackman | 62/116 |

*Primary Examiner*—Ronald C. Capossela

*Attorney, Agent, or Firm*—Warren F. B. Lindsley

[57] ABSTRACT

An engine or heat pump for a refrigeration system employing a first elongated expansion-compression device defining a pair of chambers, each having a linearly movable piston therein which are axially interconnected by a hollow cylinder. A second expansion-compression device is mounted within the cylinder. Conduit means are provided, one extending into each end of the first device, through the associated piston and into the cylinder. The first device forces working fluid received through the device to provide fluid under relatively high pressure to the power and work loops of a refrigeration system, while the second device actuated by the first device draws relatively low pressure fluid from the system and returns it under pressure to a source.

9 Claims, 5 Drawing Sheets

REFRIGERATION SYSTEM EMPLOYING REFRIGERANT OPERATED DUAL PURPOSE PUMP

BACKGROUND OF THE INVENTION

Dual loop heat pump or refrigeration systems which utilize a linear motion free-piston expansion-compression device are known in the art. Such devices utilize a single working fluid in each loop of the system having a power loop which operates on a Rankine cycle and a refrigeration or heat pump loop which operates on a vapor compression cycle. One of the disadvantages of these prior art systems is that the operational efficiency thereof is poor because the linear momentum and temporary storage of kinetic energy in the free piston assembly is not utilized to compress the working fluid in the refrigeration or heat pump loop. This has resulted in such prior art systems being economically unfeasible. Further, these systems require a relatively high operating temperature and pressure for the power loop working fluid, thereby limiting the operating range.

The present invention uses heat energy as a power source for moving heat from one point to another, relying for operation upon a temperature difference between a cooled and uncooled environment.

DESCRIPTION OF THE PRIOR ART

U.S. Pat. No. 2,986,907 discloses a refrigeration system designed to operate from a low energy source such as hot water or a small capacity electrical heating unit. A pair of pistons are connected together in a housing with each piston designed to compress a low flash point refrigerant. The pistons are powered by measured charges of the refrigerant which are passed through a flash chamber and there substantially and instantaneously converted from a liquid to a gas with the resulting expansion in volume used to drive the pistons against the gaseous refrigerant on the other side of the pistons for compressing it. A small injector pump is driven by the pistons to force measured charges of the refrigerant into the flash chamber for driving the system.

U.S. Pat. No. 3,823,573 discloses an automotive air conditioning apparatus wherein gas from an evaporator is introduced to a double acting piston and cylinder arrangement exhausting by a check valved conduit which then delivers the refrigerant gas at an elevated pressure to a water jacket heat exchanger.

U.S. Pat. No. 2,991,632 discloses a refrigeration system of the compressor-condenser-expansion type, wherein the compressor is driven by the refrigerant gas itself. This is accomplished by utilizing a compressor which is driven or powered by a gas or vapor under pressure, extracting a portion of the refrigerant from any suitable portion of the compressor-condenser-expander circuit, thereby increasing the pressure of the extracted refrigerant by means of a pump and increasing the volume thereof by the application of heat thereto. The expanded refrigerant is used as the power medium for driving the compressor. The refrigerant exhausted from the compressor is returned to the system for recycling.

U.S. Pat. No. 3,988,901 discloses a dual loop heat pump system including an expansion-compression device with a linearly movable free piston assembly. A Rankine cycle power loop with a working fluid is operatively connected to the expansion-compression device to drive same. A vapor compression heat pump loop with a working fluid is operatively connected to the expansion-compression device to be driven thereby.

U.S. Pat. No. 2,986,898 discloses a refrigeration system with refrigerant operated pump which is energized by the refrigerant for returning low pressure refrigerant to the high pressure side of the system.

U.S. Pat. No. 3,016,016 discloses a reciprocating pump for use as a scavenge pump in a hydraulically operated machine tool.

Other patents of interest, but not anticipatory of the claimed invention are the following:

| | |
|---|---|
| 1,091,957 | 2,637,981 |
| 1,264,399 | 3,861,166 |
| 2,209,090 | 3,710,586 |
| 2,468,393 | 4,693,090 |

SUMMARY OF THE INVENTION

In accordance with the invention claimed, an improved heat activated heat pump is provided for primary utilization as a refrigeration system. The heat pump of the invention employs a pair of axially arranged cylinders having two spacedly positioned and interconnected pistons arranged, one in each cylinder, with a smaller cylinder containing a liquid refrigerant pump forming the interconnection of the spacedly arranged pistons. One piston acts as a power driver for the other, which services in a pumping mode to move refrigerant in the heat transfer loop. The refrigerant pump in the second cylinder is operated by the movement of the two pistons.

It is, therefore, an object of the present invention to provide a new and improved actuator, engine or heat actuated heat pump for, inter alia, a refrigeration system.

Another object of this invention is to provide a heat pump that is powered exclusively by heat energy drawn directly from the surrounding environment.

A further object of this invention is to provide a new and improved engine embodying a liquid refrigerant pump within its geometrical configuration.

A still further object of this invention is to provide an encased interconnected dual piston arrangement for a power source, the interconnection of which contains a liquid refrigerant pump.

A still further object of this invention is to provide a heat pump in a simplified form, utilizing a reduced number of elements as compared with prior art heat actuated heat pumps.

A still further object of this invention is to provide a heat actuated heat pump that uses only a single refrigerant in both the power and work loops.

Further objects and advantages of the invention will be pointed out with particularity in the claims annexed to and forming a part of this specification.

BRIEF DESCRIPTION OF THE DRAWINGS

The present invention may be more readily described with reference to the accompanying drawings, in which.

DESCRIPTION OF THE PREFERRED EMBODIMENT

Figure 1:
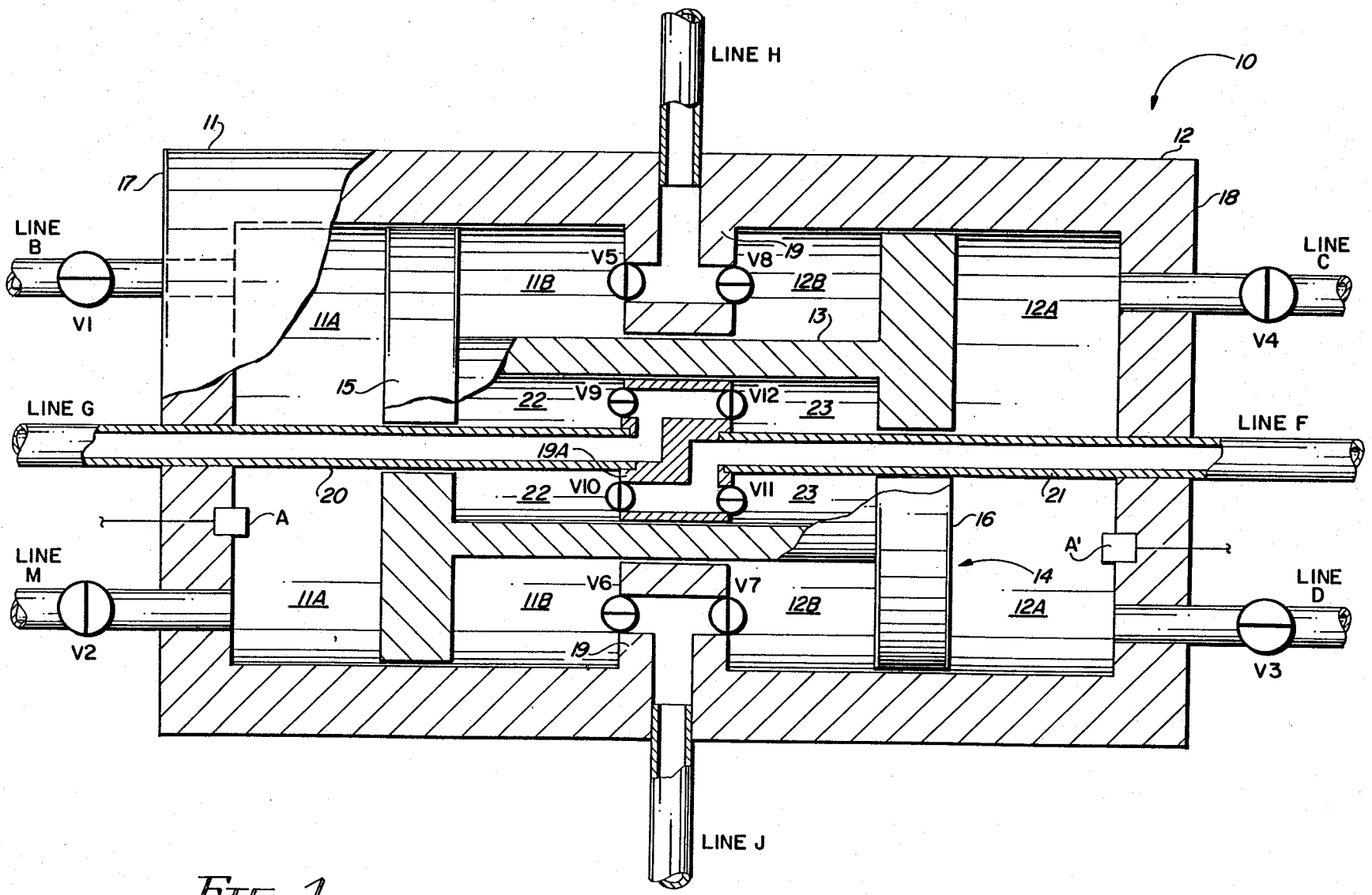
FIG. 1 is a diagrammatic illustration of a new and improved engine employing a coaxially arranged dual cylinder and piston arrangement having a liquid refrigerant pump encased in the interconnecting structure of the piston assembly.

Referring more particularly to the accompanying drawings by characters of reference, FIG. 1 illustrates in simplified form a nested engine or heat pump 10 comprising two axially aligned similar diameter cylinders 11 and 12 enclosing a smaller diameter cylinder 13.

A piston assembly 14 comprising two identical sized interconnected pistons 15 and 16 are fitted one in the interior of each of cylinders 11 and 12 for movement axially therealong with a hollow shaft forming cylinder 13 connecting the pistons 15 and 16 together.

Each of the pistons 15 and 16 are provided with one or more seals to prevent leakage of refrigerant around the associated piston.

As noted from FIG. 1, the cylinder assembly comprising cylinders 11 and 12 is provided with end caps or flanges 17 and 18 and a common center flange 19.

In each case, pistons 15 and 16 divide their respective cylinders 11 and 12 into sub-chambers 11A, 11B and 12A and 12B, respectively, with chamber 11 having inlet-outlet valves V1 and V2 and chamber 12 having inlet-outlet valves V3 and V4. Valves V1 and V3 and V2 and V4 work in unison. When valves V1 and V3 are open, valves V2 and V4 are closed and vice versa. Valves V1 and V4 control intake ports and valves V2 and V3 control exhaust ports.

Inside of center flange 19 is provided two tees, with each tee being provided with two one-way valves typically but not necessarily reed valves.

These valves are designated V5, V6, V7 and V8, with valves V5 and V8 of one of the tees being arranged to accept only incoming refrigerant. The other valves V6 and V7 are arranged to control only outgoing refrigerant. Each tee ports to a refrigerant line and to each side of the center flange. Valves V5 and V7 and valves V6 and V8 work in unison. When valves V5 and V7 are open, valves V6 and V8 are closed and vice versa. At all times, two valves are open and two valves are closed.

Inside of the inner cylinder 13 is arranged a continuation of the center flange 19. Although separated from the center flange 19 by the walls of cylinder 13, this part 19A of the center flange does not reciprocate with the piston assembly, but is firmly anchored by pipes or conduits 20 and 21 which are attached at both of its ends and extend through the associated pistons 15 and 16, respectively.

In addition, the central part 19A of flange 19 functions as a valve body containing four valves, typically but not necessarily reed valves. These valves are identified as valves V9, V10, V11 and V12. Valves V9 and V12 function only as exhaust valves, and valves V10 and V11 function only as intake valves, with valves V9 and V11l being open when valves V10 and V12 are closed and vice versa.

The space inside of cylinder 13 is used as a liquid pump. As the piston assembly reciprocates, sufficient pressure is exerted on sub-chambers 22 and 23 formed inside of cylinder 13, and to the left and right, respectively, of central part 19A of flange 19 to pump liquid refrigerant through the conduits 20 and 21 forming a pipe line to a power evaporator or boiler, later identified in the description of FIG. 2. This function is necessary as liquid refrigerant enters chambers 22 and 23 from a source such as a power condenser operating at 85 PSI (pounds per square inch), while another associated source of a power evaporator operates at a 150 PSI.

A typical, but not limiting use of the engine or heat pump 10, as shown in FIG. 1, is for an air conditioning system having two refrigerant conducting loops, namely a power loop and a work loop.

Figure 2:
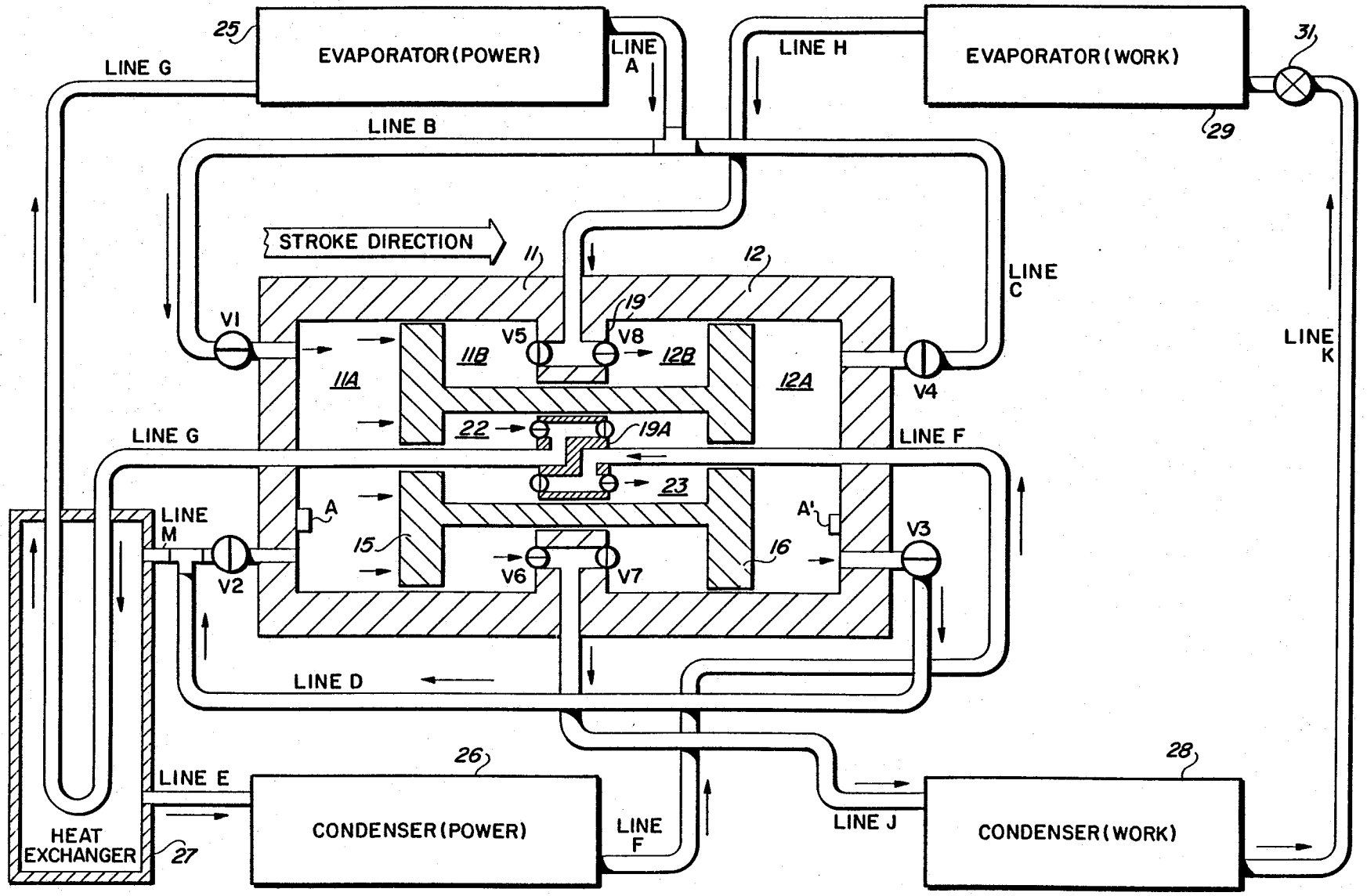
FIG. 2 is a functional block diagram of a refrigeration system employing the engine configuration of FIG. 1.

FIG. 2 illustrates heat pump 10 in a system embodying both loops with the power loop comprising a boiler or other heat source acting as an evaporator 25, a heat exchanger 26 acting as a condenser and another heat exchanger 27 acting as a preheater and precooler with liquid refrigerant from line G passing through exchanger 27 and with exchanger 27 absorbing heat from the refrigerant on its way to boiler, i.e. evaporator 25. The work loop comprises the heat pump 10 in series with condenser 28 and evaporator 29 as hereinafter defined.

Using the engine or heat pump 10 in the power loop described, the sequence of operation of this apparatus is as follows:

Liquid refrigerant is heated by the boiler or evaporator 25 and boils off into a gas and consequently develops a higher pressure than when in its liquid form. As this happens, the gaseous refrigerant generated by evaporator 25 flows through lines A and B, open valve V1 and into chamber 11A of cylinder 11.

It should be noted that wherever the term "line" is used herein, it is intended that the term define a conduit or fluid passageway.

Fluid pressure of the refrigerant is considerably lower in the power condenser 26 than in the boiler or evaporator 25 so that when valve V3 is opened, there is a rush of high pressure vapor refrigerant from chamber 12A of cylinder 12 through a line D, line M, into precooler/preheater heat exchanger 27 where it is precooled and then through line E to power condenser 26. As pressure rises in chamber 11A of cylinder 11, the piston assembly comprising piston 15, cylinder 13 and piston 16, under the influence of piston 15, moves toward the right in cylinder 1 and 12, as shown in FIG. 2. This movement puts pressure on the fluid in chamber 12A of cylinder 12, causing the remaining refrigerant from a previous cycle to flow out of chamber 12A through valve V3 into line D, line M, through the precooler portion of heat exchanger 27, line E and then into power condenser 26. Power condenser 26 drops the pressure of the refrigerant vapor, causing the vapor to convert in a liquid.

As piston 16 moves to the right, as shown in FIG. 2, away from the center flange 19, it creates a vacuum in chamber 23. This vacuum creates a suction in line F formed by conduit 21 so that liquid refrigerant is drawn from the power condenser 26 through line F, valve V11 into chamber 23.

At the same time, piston 15 is developing pressure on the fluid in chamber 22, causing liquid refrigerant to flow through valve V9, line G to heat exchanger 27 where it is preheated as it flows through line G to the boiler or evaporator 25 thereby completing a closed power loop function.

Piston 15 also compresses the vapor refrigerant in chamber 11B which flows through valve V6, line J to a work condenser 28 where it is converted into a liquid and then through work evaporator 29 and cylinder 13 of the heat pump configuration.

In this example of the invention, pressure in condenser 28 is approximately 85 PSI and pressure in work evaporator 29 connected thereto is 40 PSI. Therefore, liquid refrigerant flows from the higher pressure source through line K, expansion valve 31 where it vaporizes into work evaporator 29. As piston 16 moves toward the right end of cylinder 12, as shown in FIG. 2, a suction is created in chamber 12B of cylinder 12, drawing vapor refrigerant into it from work evaporator 29 through valve V8 and line H.

When piston 16 nears the end of its movement or stroke to the right end of cylinder 12, an actuator A' reverses the position of valves V1 through V4. Valves V1 and V3 are now closed, with valves V2 and V4 now being open. Fluid pressure in chamber 11A has now equalized at 150 PSI while valve V1 was open so that when it closed and valve V2 opened, there was a rush of vapor refrigerant through valve V2, line M and into line E flowing through preheater precooler heat exchanger 27 to power condenser 26, where it is equalized at a pressure of 85 PSI.

As the pressure dropped in chamber 11A, vapor refrigerant from the boiler or evaporator 25 moves through line A, line C, valve V4 and into chamber 12A of cylinder 12. As pressure grows, the piston assembly comprising piston 16, cylinder 13 and piston 15 moves to the left, as shown in Fig. 2, forcing the balance of the vapor remaining in chamber 11A through valve V2 and line M into precooler/preheater heat exchanger 27 and through line E and into power condenser 26 where it liquifies.

As piston 15 moves toward the end of its stroke to the left in cylinder 11, a vacuum is created in chamber 22, thereby creating a suction in line F drawing liquid refrigerant into it through valve V10.

As the volume of chamber 23 is compressed, liquid refrigerant in chamber 23 is pumped (against the 150 PSI pressure of the boiler or evaporator 25) through valve V12, line G, heat exchanger 27 where it is preheated and back to the boiler or evaporator 25.

Movement of piston 16 puts pressure on the fluid in chamber 12B of cylinder 12 with vapor refrigerant flowing through valve V7, line J and into work condenser 28. With the aforementioned pressure difference between work condenser 28 and work evaporator 29, liquid refrigerant flows through line K, expansion valve 31 and into work evaporator 29 as a vapor.

The piston movement that compressed the volume of chamber 12B also creates a vacuum in chamber 11B of cylinder 11 which, in turn, creates a suction that draws vapor refrigerant through valve V5 from line H into chamber 11B.

At the end of this stroke, piston 15 actuates an actuator A reversing the position of valves V1, V2, V3 and V4 which, in turn, reverses the direction of movement of pistons 15 and 16, thus completing a cycle of operation of the apparatus shown in FIG. 2.

Figure 3:
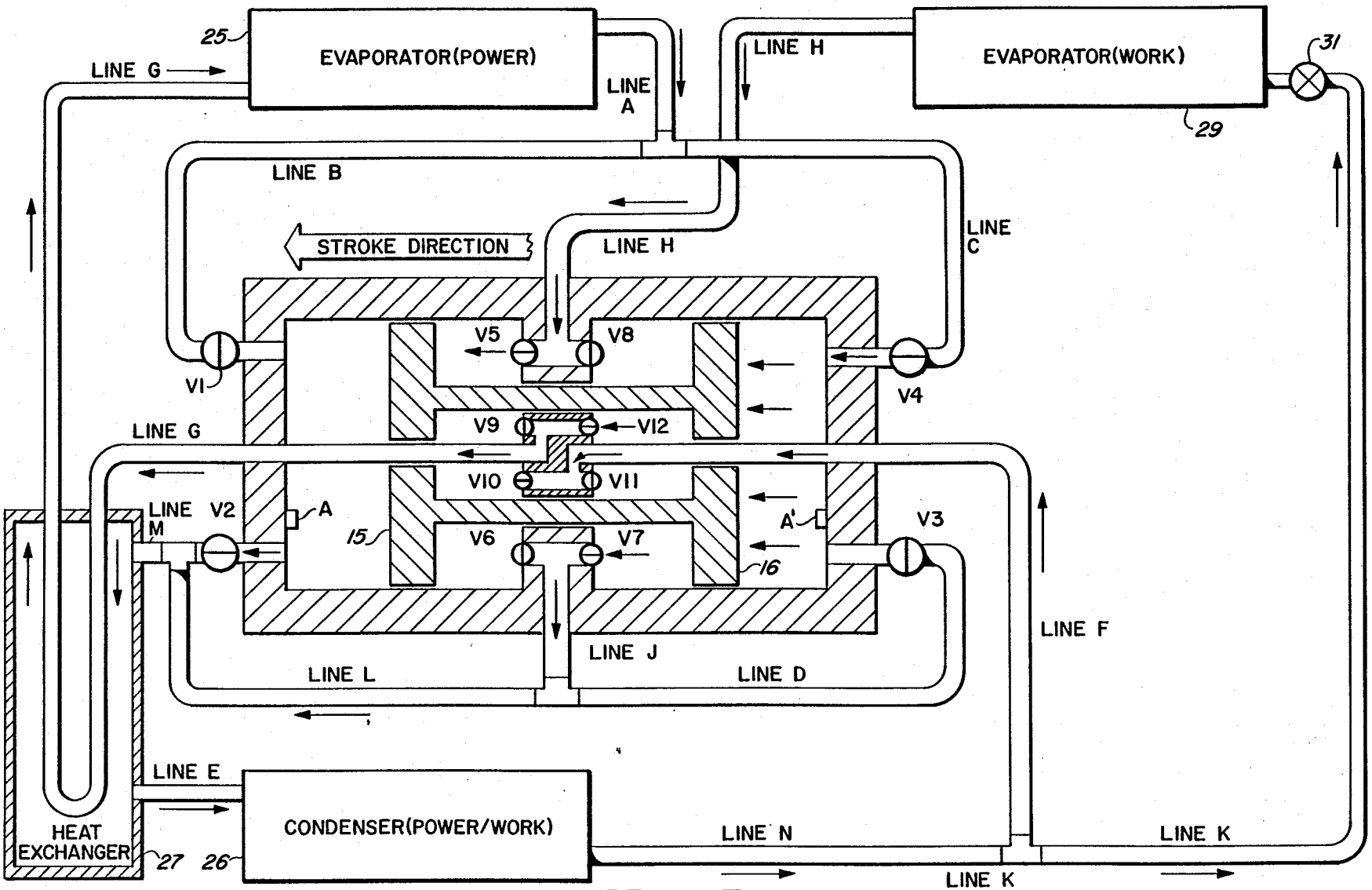
FIG. 3 is a functional block diagram of a modification of the refrigeration system illustrated in FIG. 2 employing a single condenser in both the power and work loops of the system.

FIG. 3 is a modification of FIG. 2 wherein similar parts are given the same reference characters and operate as heretofore described.

Notable in this configuration is the fact that vapor refrigerant exhausted from the engine or heat pump 10 through lines D, J and M is from both the power and work loops, but is mixed before entering the precooler/-preheater heat exchanger 27 and condenser 26.

After leaving condenser 26 as a liquid, the refrigerant flows through line N where some of it enters line F and becomes part of the power loop and the balance goes through line K and becomes part of the work loop.

Using the apparatus shown in FIG. 3, liquid refrigerant is heated by boiler or evaporator 25, boils off into a gas, and consequently develops higher pressure. As this happens, it flows through lines A and C, open valve V4 and into chamber 12A. Pressure is considerably lower in condenser 26 than in the boiler, so when valve V2 opens, there is a rush of high pressure vapor refrigerant from chamber 11A through line M and into preheater/-precooler heat exchanger 27, where it is precooled before moving through line E to condenser 26. As pressure rises in chamber 12A, the piston assembly moves toward the other end of the engine. This movement puts pressure on chamber 11A, causing the remaining refrigerant to flow through valve V2 into line M, heat exchanger 27 and then condenser 26. The condenser drops the pressure, condensing the vapor refrigerant into a liquid.

As piston 15 moves away from the center divider, it creates a vacuum in chamber 22. This creates a suction on line F, so liquid refrigerant is drawn from condenser 26, through line F, valve V10 and into chamber 22.

At the same time, piston 16 is putting pressure on chamber 23. This causes liquid refrigerant to flow through valve V12, line G and heat exchanger 27, where it is preheated as it flows to the boiler. This completes a loop.

Piston 16 also compresses the vapor refrigerant in chamber 12B. The refrigerant goes through valve V7, lines J, L and M, to the heat exchanger where it gives off heat, through line E and then into condenser 26 where it becomes a liquid. In this example, pressure in condenser 26 is 85 PSI, and pressure in work evaporator 29 is 40 PSI. Therefore, liquid refrigerant flows from the higher pressure through line K, through expansion valve 31 (where it vaporizes) and into work evaporator 29. As piston 15 moves toward the left end of the engine or heat pump 10, a suction is created in chamber 11B, drawing vapor refrigerant into it from work evaporator 29 through valve V5 and line H.

When piston 15 nears the end of its stroke, an actuator A reverses valves V1 through V4. Valves V1 and V3 are now open and valves V2 and V4 are now closed. Pressure in chamber 12A had equalized with the boiler or evaporator 25 at 150 PSI pressure while valve V4 was open, so when it closed and valve V3 opened, there was a rush of vapor refrigerant through valve V3 into lines D, L and M, then into preheater/precooler heat exchanger 27, line E and then condenser 26 with all the fluid in them being equalized at 85 PSI.

As pressure dropped in chamber 12A, vapor refrigerant moved down lines A and B, through valve V1 and into chamber 11A. As pressure builds up in chamber 11A, the piston assembly moves in the opposite direction, forcing the balance of the vapor remaining in chamber 12A through valve V3 into lines D, L and M, then into preheater/precooler heat exchanger 27, line E and into condenser 26, where it liquifies.

As piston 16 moves toward end flange 18, a vacuum is created in chamber 23. This vacuum creates a suction on line F, drawing liquid refrigerant into it through valve V11.

As chamber 22 is also compressed, liquid refrigerant in chamber 22 is pumped (against the 160 PSI pressure of the power boiler or evaporator 25) through valve V9, line G, heat exchanber 27 where it is preheated, and back to the power boiler or evaporator 25.

Movement of piston 15 to the right, as shown in FIG. 3, puts pressure on chamber 11B. Vapor refrigerant flows through valve V6, lines J, L and M, preheater/-precooler heat exchanger 27, line E and into chamber 26. With the aforementioned pressure difference between condenser 26 and work evaporator 29, liquid refrigerant flows through line K to expansion valve 31 and into evaporator 29 as a vapor. At the end of this stroke, an actuator A′ reverses valves V1, V2, V3 and V4 which, in turn, reverses the direction of the piston assembly movement. This completes one cycle of the engine or heat pump.

Figure 4:
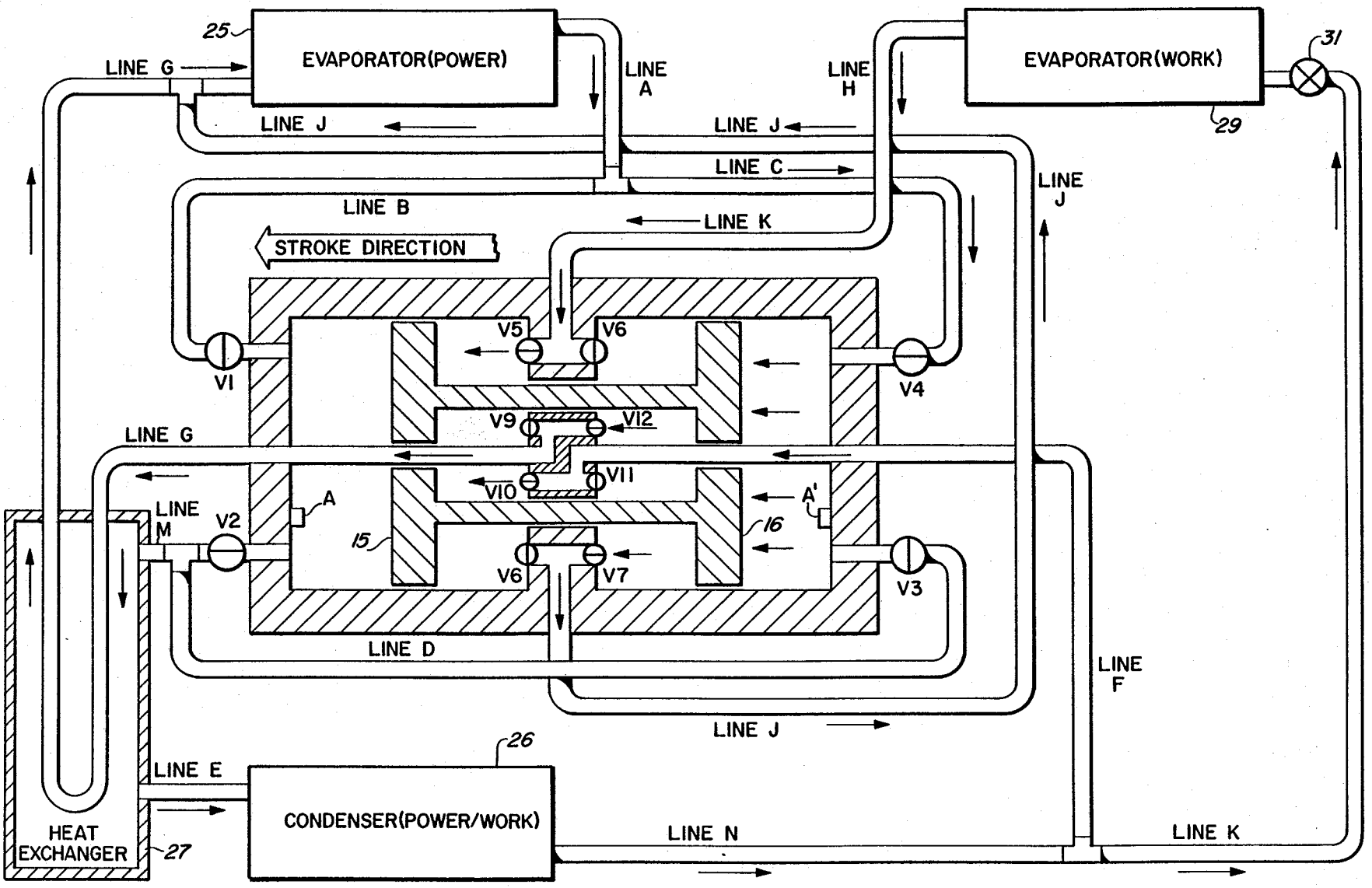
FIG. 4 is a functional diagram of a modification of the refrigeration system illustrated in FIG. 3 employing a heat exchanger in the work loop.

FIG. 4 is a modification of the apparatus shown in FIG. 3 wherein like parts are given the same reference characters. The only difference is one of plumbing changes.

Vapor refrigerant exhausted from chambers 11B and 12B enters line J and is transported directly to line G just before it enters the power boiler or evaporator 25.

In FIG. 3, vapor refrigerant exhausting from chambers 11B and 12B enter line J, but emptied into line L from which it passes through precooler/preheater heat exchanger 27 to condenser 26.

Stated simply, vapor refrigerant exhausting from chambers 11B and 12B goes to power evaporator 25 instead of condenser 26.

Figure 5:
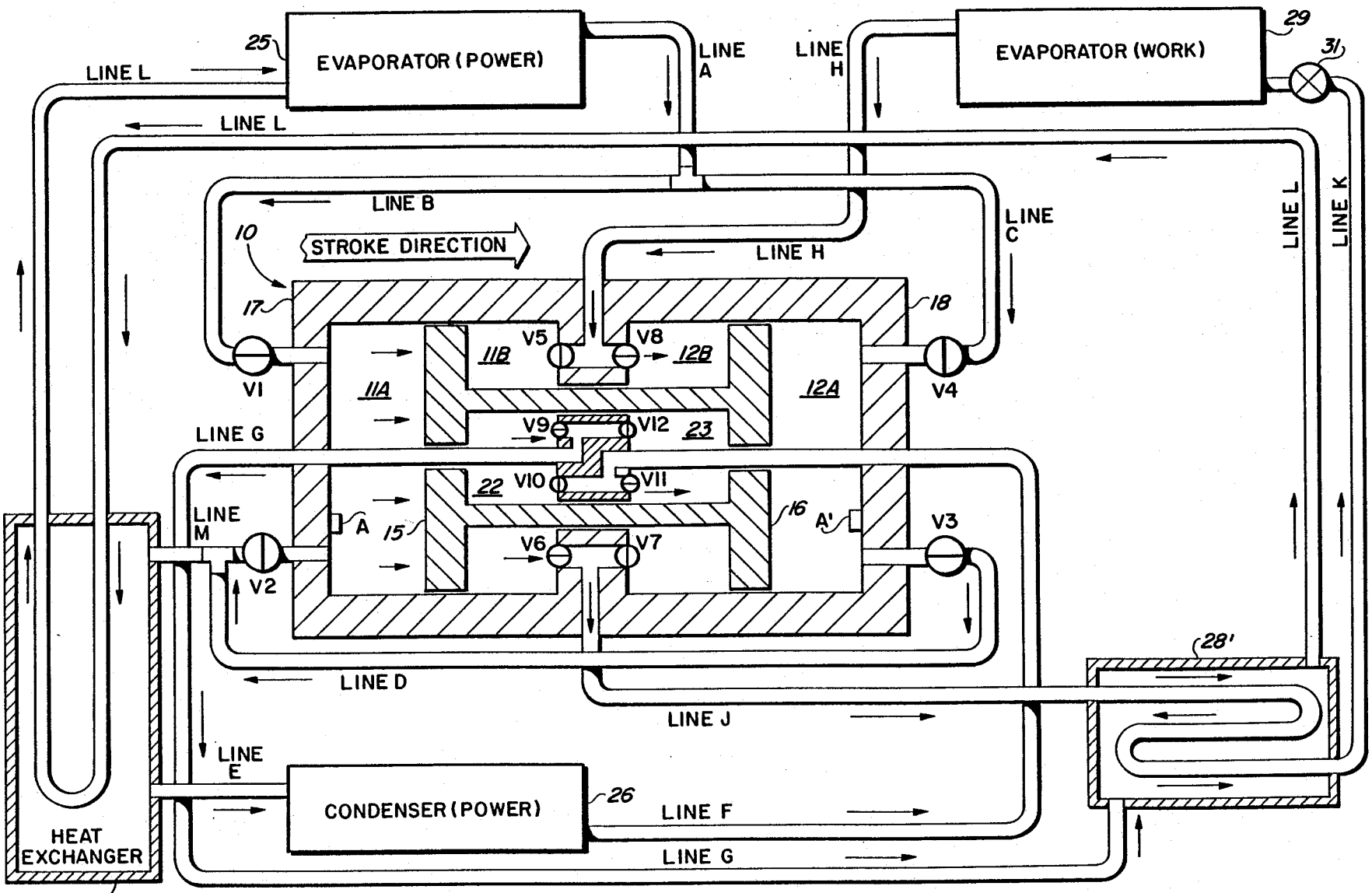
FIG. 5 is a functional block diagram of a modification of the refrigeration system shown in FIG. 2 employing a heat exchanger in both the power and work loops of the system.

FIG. 5 discloses a further modification of FIG. 2 with like parts having the same reference characters and wherein condenser 28 of FIG. 2 is modified as condenser 28′ to serve also as a preheater.

Liquid refrigerant is heated in evaporator 25, boils off into a gas, and consequently develops higher pressure. As this happens, it flows through line A, and since valve V4 is closed, down line B, through valve V1 into chamber 11A. Pressure in chamber 12A had equalized with the power evaporator 25 at approximately 150 PSI, so when valve V4 closed and valve V3 opened, there was an immediate rush of refrigerant vapor into line D, which had been equalized with the power condenser 26 at about 85 PSI. As pressure builds in chamber 11A, the piston assembly moves toward chamber 12A pushing the remaining vapor into line D, line M and into the preheater/precooler heat exchanger 27 where it gives off some of its heat, warming liquid refrigerant in line L, and precooling itself before entering line E and then power condenser 26.

The movement of piston 16 away from the center flange has created a suction in chamber 23. Since valve V11 is mounted as an intake valve on chamber 23, the suction there creates a suction on line F. This suction draws liquid from power condenser 26, through line F and into chamber 23.

The same piston movement mentioned above causes piston 15 to put pressure on chamber 22. Valve V9 is mounted as an exhaust valve, so when sufficient pressure builds up to overcome the 150 PSI pressure of evaporator 25, liquid refrigerant will flow through valve V9 and line G to work condenser 28′ where it acts as the coolant on hot vapor coming through line J. It then continues through line L to the preheater/ precooler heat exchanger 27 where it picks up some heat on its way to power evaporator 25.

In the work loop, as piston 16 moved away from the center flange, it created a suction in chamber 12B and draws vapor refrigerant into it from work evaporator 29 through line H and valve V8.

The piston movement causes piston 15 to put pressure on chamber 11B which forces vapor refrigerant through valve V6 and line J into work condenser 28′ where it condenses into a liquid. Since pressure in the work evaporator is roughly 40 PSI and line J at the condenser is roughly 85 PSI, liquid refrigerant flows through line K to expansion valve 31 where it vaporizes and then into work evaporator 29.

This completes one engine stroke for both loops.

As the piston assembly reaches the end of its stroke, an actuator A′ reverses valves V1 through V4. Valves V1 and V3 are now closed and valves V2 and V4 are open.

Pressure in chamber 11A had equalized with the boiler or evaporator 25 at 150 PSI while valve V1 was open, so when it closed and valve V2 opened, there was a rush of vapor refrigerant through valve V2, line M, the preheater/precooler heat exchanger 27, line E and power condenser 26, all of which had equalized at 85 PSI.

As pressure drops in chamber 11A, vapor refrigerant moves from the power evaporator 25 down lines A and C through valve V4 into chamber 12A. As pressure in chamber 12A builds up, the piston assembly moves in the opposite direction, forcing the balance of the vapor remaining in chamber 11A through valve V2 into line M, preheater/precooler heat exchanger 27, line D, and into power condenser 26, where it liquifies.

As piston 15 moves toward end flange 17, a vacuum is created in chamber 22. This vacuum creates a suction on line F, drawing liquid refrigerant into it through valve V10.

As chamber 23 is also compressed, liquid refrigerant in it is pumped (against the 150 PSI pressure of the power boiler or evaporator 25) through valve V12, line G, through work condenser 28′ where it picks up heat from line J, through line L to preheater/precooler heat exchanger 27 where it again picks up heat, and on to power evaporator 25.

In the work loop, movement of piston 16 also puts pressure on chamber 12B. Vapor refrigerant flows through valve V7, line J to work condenser 28′ where it gives off heat and liquifies, then through line K to expansion valve 31, and into work evaporator 29 where it again is turned into a vapor.

As piston 15 moves away from center flange 19, it creates a vacuum in chamber 11B. This vacuum puts a suction on line H, and draws vapor refrigerant from work evaporator 29 through valve V5 into chamber 11B. At the end of this stroke, once again an actuator reverses valves V1 through V4 which, in turn, reverses the direction of the piston movement.

This completes one full cycle of the engine.

An improved heat actuated heat pump or engine is thus provided in accordance with the stated objects of the invention, and although but a few embodiments of the invention have been illustrated and described, it will be apparent to those skilled in the art that various changes and modifications may be made therein without departing from the spirit of the invention or from the scope of the appended claims.

What is claimed is:

1. An engine comprising:

a first elongated expansion-compression device having a pair of ends and defining a pair of axially aligned first and second chambers separated by a common flange and each having a linearly movable piston therein which are axially interconnected by a hollow cylinder extending through said flange, each of the pistons divide its associated chamber into a first sub-chamber and a second sub-chamber of varying size as its associated piston moves therealong, a second expansion-compression device mounted within said cylinder and comprising a stationary member forming a portion of said flange extending laterally across said cylinder, said member dividing the hollow interior of said cylinder into third and fourth sub-chambers of varying size as the pistons of said first device moves along their associated chambers, conduit means, one extending into each end of said first device and through its associated piston and into said cylinder, passageways formed in said portion of said flange, each connecting a different one of said third and fourth subchambers to the hollow interior of a different one of said conduit means, each of the first and second sub-chambers having a first inlet port and a first outlet port and first valve means associated with each first inlet and first outlet port for controlling the flow of a refrigerant therethrough, and each of the third and fourth sub-chambers having a second inlet port and a second outlet port formed in said portion of said flange and second valve means associated with each second inlet and each second outlet port for controlling the flow of refrigerant from one of the third and fourth subchambers through one of said passageways and into one of said conduit means, said valve means of the first and second devices open and close their associated ports in a predetermined sequence.

2. The engine set forth in claim 1 wherein:

each of said conduit means extend axially into each end of said first device and through its associated piston and into different ends of said cylinder.

3. The engine set forth in claim 2 wherein:

each of said conduit means are fixedly attached to a different one of said passageways formed in said portion of said flange.

4. A refrigerating system comprising:

a fluid conducting power loop comprising a first evaporator interconnected with a condenser means, a fluid conducting work loop comprising a second evaporator interconnected with said condenser means, said power loop and said work loop having a working fluid, engine means for moving said working fluid through said power loop and simultaneously drawing working fluid from said work loop, said engine means comprising a cylinder, piston means mounted in said cylinder and a pump means mounted within said cylinder and actuated by said piston means upon movement thereof, a first line connecting one side of said condenser means to one side of said piston means, a suction line connecting said second evaporator to said one side of said piston means, a second line connecting said other side of said condenser means to the suction side of said pump means, a third line connecting the pressure side of said pump means to said first evaporator, and a fourth line for high pressure gaseous refrigerant connecting said first evaporator to the other side of said piston means for actuating said piston means in response to high pressure in said fourth line to move working fluid through said condenser means and to cause said pump means to draw relatively low pressure working fluid from said second line into said pump means, said pump means causing said working fluid to be moved under pressure through said fourth line and into said first evaporator to complete a cycle of operation of said refrigeration system.

5. The refrigeration system set forth in claim 4 in further combination with:

a heat exchanger, said heat exchanger comprising a pipe line extending therethrough forming a part of said third line and a hollow enclosed jacket forming a part of said first line.

6. A refrigerating system comprising:

a fluid conducting power loop comprising a first evaporator interconnected with a first condenser means, a fluid conducting work loop comprising a second evaporator interconnected with a second condenser means, said power loop and said work loop having the same type of working fluid, engine means for moving said working fluid through said power loop and simultaneously drawing working fluid from said work loop, said engine means comprising a cylinder, piston means mounted in said cylinder and a pump means mounted within said cylinder and actuated by said piston means upon movement thereof, a first line connecting one side of first condenser means to one side of said piston means, a suction line connecting said second evaporator to said one side of said piston means, a second line connecting said other side of said first condenser means to the suction side of said pump means, a third line connecting the pressure side of said pump means to said first evaporator, a fourth line connecting said second condenser means to said one side of said piston means, and a fifth line for high pressure gaseous refrigerant connecting said first evaporator to the other side of said piston means for actuating said piston means in response to high pressure in said fifth line to move working fluid through said second condenser means and to cause said pump means to draw relatively low pressure working fluid from said second line into said pump means, said pump means causing said working fluid to be moved under pressure through said third line and into said first evaporator to complete a cycle of operation of said refrigeration system.

7. The refrigeration system set forth in claim 6 in further combination with:

a heat exchanger, said heat exchanger comprising a pipe line extending therethrough and forming a part of said third line and a hollow jacket forming a part of said first line.

8. The refrigeration system set forth in claim 6 in further combination with:

a first heat exchanger, and a second heat exchanger, said first heat exchanger comprising a first pipe line extending therethrough and forming a part of said third line, and a first hollow jacket forming a part of said first line, said second heat exchanger comprising a second pipe forming a part of said fourth line, and said second jacket forming a part of said third line.

9. A refrigerating system comprising:

a fluid conducting power loop comprising a first evaporator interconnected with a condenser means, a fluid conducting work loop comprising a second evaporator interconnected with said condenser means, said power loop and said work loop having a common working fluid, engine means comprising a first elongated expansion-compression device having a pair of ends and defining a pair of axially aligned first and second chambers separated by a common flange and each having a linearly movable piston therein which are axially interconnected by a hollow cylinder extending through said flange, each of the pistons divide its associated chamber into a first sub-chamber and a second sub-chamber of varying size as its associated piston moves therealong, a second expansion-compression device mounted within said cylinder forming a pump and comprising a stationary member forming a portion of said flange extending laterally across said cylinder, said member dividing the hollow interior of said cylinder into third and fourth sub-chambers of varying size as the pistons of said first device moves along their associated conduit means, one extending into each end of said first device and through its associated piston and into said cylinder, passageways formed in said portion of said flange, each connecting a different one of said third and fourth subchambers to the hollow interior of a different one of said conduit means, each of the first and second sub-chambers having a first inlet port and a first outlet port and first valve means associated with each first inlet and first outlet port for controlling the flow of a refrigerant therethrough, and each of the third and fourth sub-chambers having a second inlet port and a second outlet port formed in said portion of said flange and second valve means associated with each second inlet and each second outlet port for controlling the flow of refrigerant from one of the third and fourth subchambers through one of said passageways and into one of said conduit means, said valve means of the first and second devices open and close their associated ports in a predetermined sequence, a first line connecting one side of said condenser means to one of the first and second sub-chambers, a suction line connecting said second evaporator alternately to the other of said first and second sub-chambers at a point in between the two pistons, a second line connecting said other side of said condenser means to the suction side of said second pump, and a third line connecting the pressure side of said pump to said first evaporator, and a fourth high pressure gaseous refrigerant line alternately connecting said first evaporator to said inlet port of said first and second sub-chambers for actuating one of said pistons to move working fluid separately to said condenser means and to cause working fluid to be simultaneously drawn from said suction line into one of said third and fourth sub-chambers and pumped by said second device into one of said conduit means and into said first evaporator to complete said power loop.

* * * * *